US006018833A

United States Patent [19]

Imm

[11] Patent Number: 6,018,833

[45] Date of Patent: Feb. 1, 2000

[54] AUTOMATED WELDLESS INTER-LOCKING GRATING ASSEMBLY FOR BRIDGE DECKS AND LIKE STRUCTURES

[75] Inventor: Dennis M Imm, Vandergrift, Pa.

[73] Assignee: Stargrate Systems, Inc., Murrysville, Pa.

[21] Appl. No.: 09/151,241

[22] Filed: Sep. 14, 1998

Related U.S. Application Data

[60] Provisional application No. 60/058,958, Sep. 16, 1997.

[51] Int. Cl.[7] ..... E01D 19/12

[52] U.S. Cl. ..... 14/73; 404/70; 52/664

[58] Field of Search ..... 14/73; 404/70; 52/664, 667, 668, 669

[56] References Cited

U.S. PATENT DOCUMENTS

| | | | |
|---|---|---|---|
| 2,128,753 | 8/1938 | Lienhard | 52/664 |
| 2,190,214 | 2/1940 | Nagin | 52/667 |
| 2,645,985 | 7/1953 | Beebe et al. | 52/668 |
| 2,834,267 | 5/1958 | Beebe | 52/667 |
| 4,452,025 | 6/1984 | Lew | 52/669 |
| 4,780,021 | 10/1988 | Bettigole | 404/70 |
| 4,928,471 | 5/1990 | Bartley | 52/667 |
| 5,463,786 | 11/1995 | Mangone et al. | 14/73 |
| 5,509,243 | 4/1996 | Bettigole et al. | 14/73 |
| 5,533,221 | 7/1996 | Majnaric et al. | 14/73 |
| 5,604,949 | 2/1997 | Mangone | 14/73 |
| 5,642,549 | 7/1997 | Mangone | 14/73 |
| 5,664,378 | 9/1997 | Bettigole | 404/70 |
| 5,735,008 | 4/1998 | Mangone | 14/73 |
| 5,784,741 | 7/1998 | Mangone | 14/73 |
| 5,806,121 | 9/1998 | Mangone | 14/73 |

*Primary Examiner*—Thomas B. Will
*Assistant Examiner*—Kristine Markovich
*Attorney, Agent, or Firm*—H. Keith Hauger, Esq.

[57] ABSTRACT

An automated weldless inter-locking grating assembly for bridge decks and the like which includes a plurality of primary load-bearing members located laterally, a plurality of transverse secondary load-bearing members and a plurality of trimorphic load-bearing members. Secondary load-bearing structural members are inserted sideways into apertures of primary load-bearing members and trimorphic load-bearing members. Thus, when a horizontal force is applied to alternate primary or trimorphic load-bearing members or any combination thereof, rotation of secondary load-bearing member or members occur to efficiently and automatically lock secondary load-bearing member or members into primary and trimorphic load-bearing member or members completing assemblage thereof into a rigid structural form.

27 Claims, 8 Drawing Sheets

AUTOMATED WELDLESS INTER-LOCKING GRATING ASSEMBLY FOR BRIDGE DECKS AND LIKE STRUCTURES

Provisional Application No. 60/058,958 filed Sep. 16, 1997.

BACKGROUND OF THE INVENTION

1. Field of the Invention

This invention relates generally to an automated weldless inter-locking grating assembly for bridge decks and like structures, including but not limited to, various kinds of bridge (decks, walkways, drain gratings, floor deckings, slab construction, tunnel construction and any like construction project.

2. Description of the Prior Art

Although bridge and like deck construction constitutes a well-known art stemming from ancient history that is now centuries old, there is a never-ending demand to develop new means of technology, and in particular, as the world enters or bridges into the 21st century. Welding of structural members has been commonplace in recent times regardless of whether the bridge deck or like structure was of open nature or filled with concrete. Most aforesaid bridge and other decks are constructed with grid-like forms, and in particular, when an open grating or open bridge deck is reviewed, it is seen that it constitutes main load-bearing members, secondary load-bearing members and optional trimorphic load-bearing members which are joined together by a variety of welds to optimize the deck or grating strength. Welding has been and remains a standard or usual means of assembling grids and decks encased by concrete or a like material as the structural components therein must be rigidly held while the concrete or other like material hardens over a given period of time. Thus, when the subject structure is only minimally welded, there is still an undesirable reduction in the overall strength causing deterioration of structural integrity. Thus, structural and civil engineers, construction firms, governmental agencies, public works departments and ultimately, the end users, and in particular, the taxpayers and the general public can and will appreciate advances in technology which accomplish maximum bridge and like structural strength of the subject components thereof creating an effective end unit constructed with minimal labor and material costs accomplishing maximum economies of scale.

U.S. Pat. No. 5,642,549 to Mangone discloses a weldless grating or grid for bridge decks having the well-known standard constructural configuration comprising a plurality of longitudinally extending primary load-bearing members, secondary load-bearing members and optional tertiary load-bearing members formed to be assembled and inter-locked into one unit.

U.S. Pat. No. 4,102,102 to Greulich is a non-welded metal grating consisting of a plurality of parallel horizontal beams having vertical slots whereby the lower wall of each slot is formed by the top of a free end of a tongue. Parallel cross bars rest on the tongues that extend through the slots having notches extending downwardly from the tops of the bars receiving the portions of the beams above the slots.

U.S. Pat. No. 4,780,721 to Bettigole's illustrates a method of converting conventional grid decks to an exodermic deck. Bettigole's U.S. Pat. No. 4,865,486 directs its disclosure and claims to a weldless pavement module and method for making a weldless pavement module.

Today, and predictably into the future, the demand and concerns in heavy and other construction projects are for bridge and like gratings which have high strength capability, optimization of ease to assemble, low cost in assembly and minimization of labor expended. It is noted that the prior art of such structures and gratings involve construction of weldless grates which require various labor steps and procedures to assemble the various components. The invention presented in this application meets the criteria of the modern and future times enabling a grating assembly to be efficiently and quickly secured into a rigid position ready for insertion to the bridge deck or other like structure.

SUMMARY OF THE INVENTION

It is, therefore, an object of the present invention to provide a weldless, inter-locking grating assembly for bridge decks and like structures that represents a substantial improvement over the prior art with its capacity to be rigidly inter-locked with minimal assemblage and labor effort.

It is the further object of the present invention to provide a weldless, inter-locking grating assembly which by application of moderate force to horizontal primary load-bearing members causes the said grating assembly to be rigidly inter-locked.

It is another object of the present invention to provide a grating suitable for use on bridge decks and walkways.

It is another object of the present invention to provide an automated inter-locking grating fastened together without the need for any welding.

It is the further object of the present invention to provide an inter-locking grating assembly which may be used for open bridge decks and walkways or may be utilized with a concrete component that encases at least a top portion of the grating.

It is the further object of the present invention to provide an inter-locking grating assembly for bridge decks, walkways and the like employing a primary load-bearing member and a secondary load-bearing member securely held together without welding.

It is an additional object of the present invention to provide an inter-locking grating for open or concrete encased bridge decks, walkways and the like employing primary load-bearing members, secondary load-bearing members and optional trimorphic load-bearing members held together without welding.

It is the further object of this invention to provide a weldless, inter-locking grating assembly that is simply constructed and cost efficient to produce.

It is the further object of the present invention to provide a weldless, inter-locking grating assembly which may be quickly and easily assembled.

It is the further object of the present invention to make a weldless, inter-locking grating assembly that has a lesser degree of lateral movement over previous like structures which have been revealed in the prior art.

More specifically, the present invention is an automated weldless, inter-locking grating assembly for bridge decks and like structures, comprising a multiplicity of primary load-bearing structural components, said primary load-bearing structural components having a web section extending vertically and located within said web section spaced apertures, above said spaced apertures an upper section of primary load-bearing structural components, said spaced apertures function in cooperation with opposing spaced apertures and adjacent primary load-bearing structural components; a multiplicity of secondary load-bearing structural components transversely located in relation to said primary load-bearing structural components, having a notched upper edge and a notched lower edge whereby said secondary load-bearing structural components may be positioned through said spaced apertures of said web section by sliding said secondary load-bearing structural components side wise through said apertures enabling engagement of said secondary load-bearing structural components into said primary load-bearing structural components to create an interlocked static position of said grating assembly; wherein said notches are spaced to engage said web section when said secondary load-bearing structural components are rotated from said sidewise position to a vertical position by horizontal motion of said primary load-bearing structural components, locking said primary load-bearing structural components into said secondary load-bearing structural components into an inter-locked static position, wherein said notches intersect with said web section of said primary load-bearing structural components; a multiplicity of trimorphic load-bearing structural components alternatively positioned between said primary load-bearing structural components for said locking into said secondary load-bearing structural components when said secondary load-bearing structural components are rotated from said side wise position to said vertical position; a rod slidably inserted through rod openings of said web of said primary load-bearing structural components and said trimorphic load-bearing structural components causing said grating assembly to achieve maximum rigidity and preventing lateral movement of said multiplicity of primary load-bearing structural components and said trimorphic load-bearing structural components of said grating assembly.

These objects, as well as other objects and advantages of the present invention will become apparent from the following description, in reference to the illustrations appended hereto.

BRIEF DESCRIPTION OF THE DRAWINGS

For a better understanding of the invention, reference may be had to the accompanying drawings in which.

DESCRIPTION OF PREFERRED EMBODIMENTS

Figure 1:
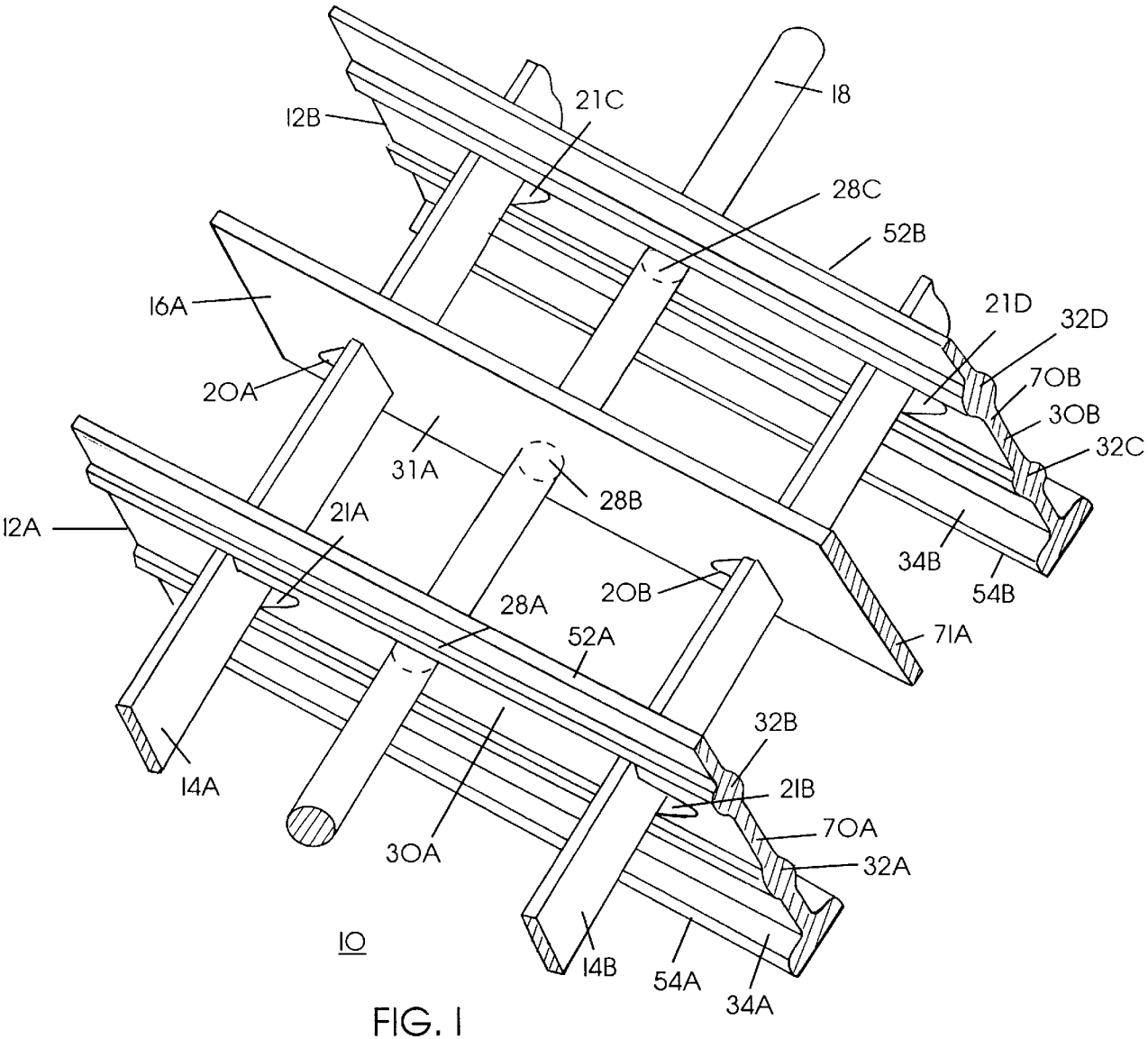
FIG. 1 is a perspective view of an automated weldless, inter-locking grating assembly in accordance with the invention depicting a secondary load-bearing bar locked in the web of a primary load-bearing bar and trimorphic load-bearing bar.
Figure 2:
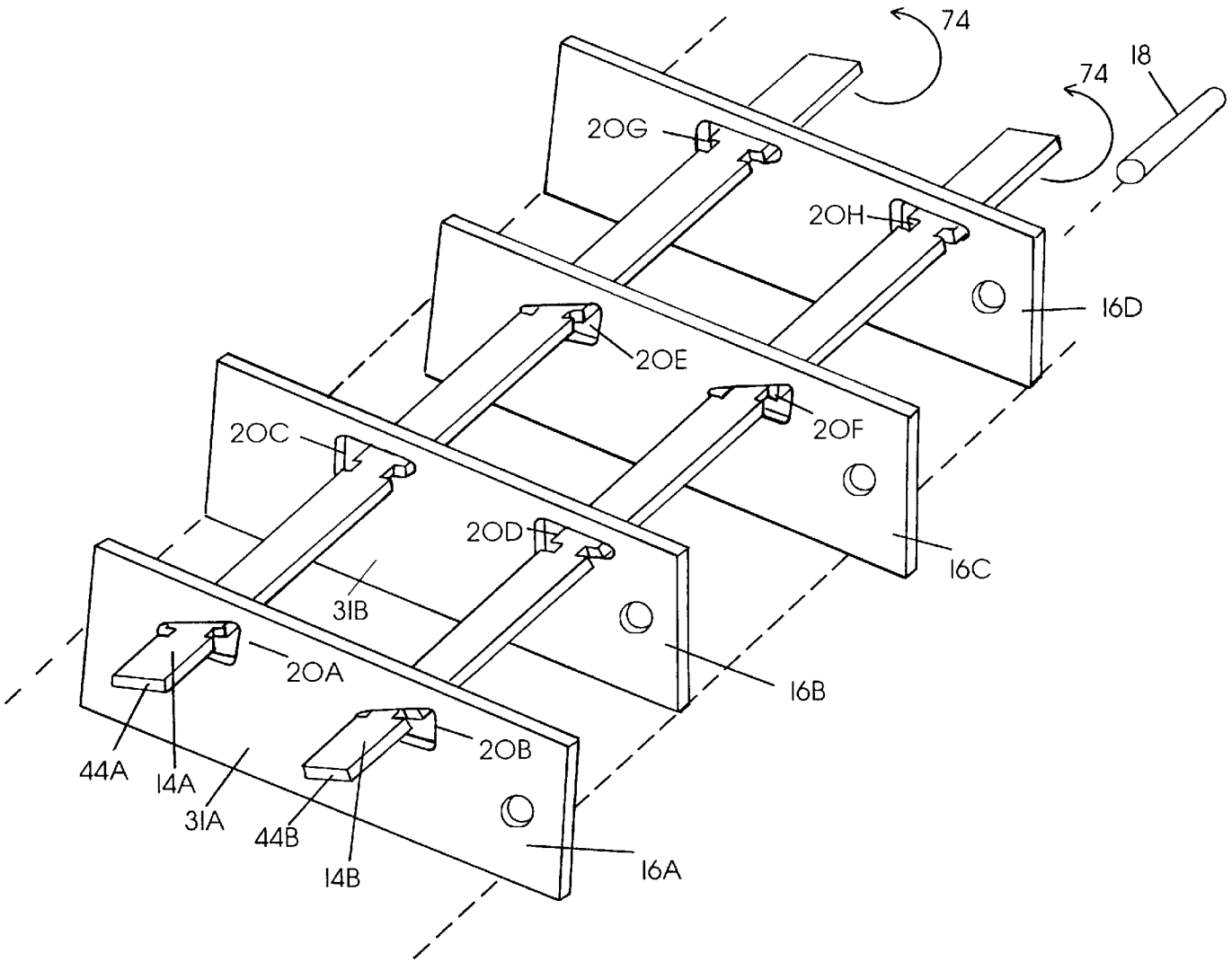
FIG. 2 is a perspective view of the proposed invention illustrating a series of trimorphic load-bearing bars with secondary load-bearing bars inserted sideways in order that a horizontal force may be applied to said trimorphic load-bearing bars for rotation of said secondary load-bearing bars to a vertical position.
Figure 3:
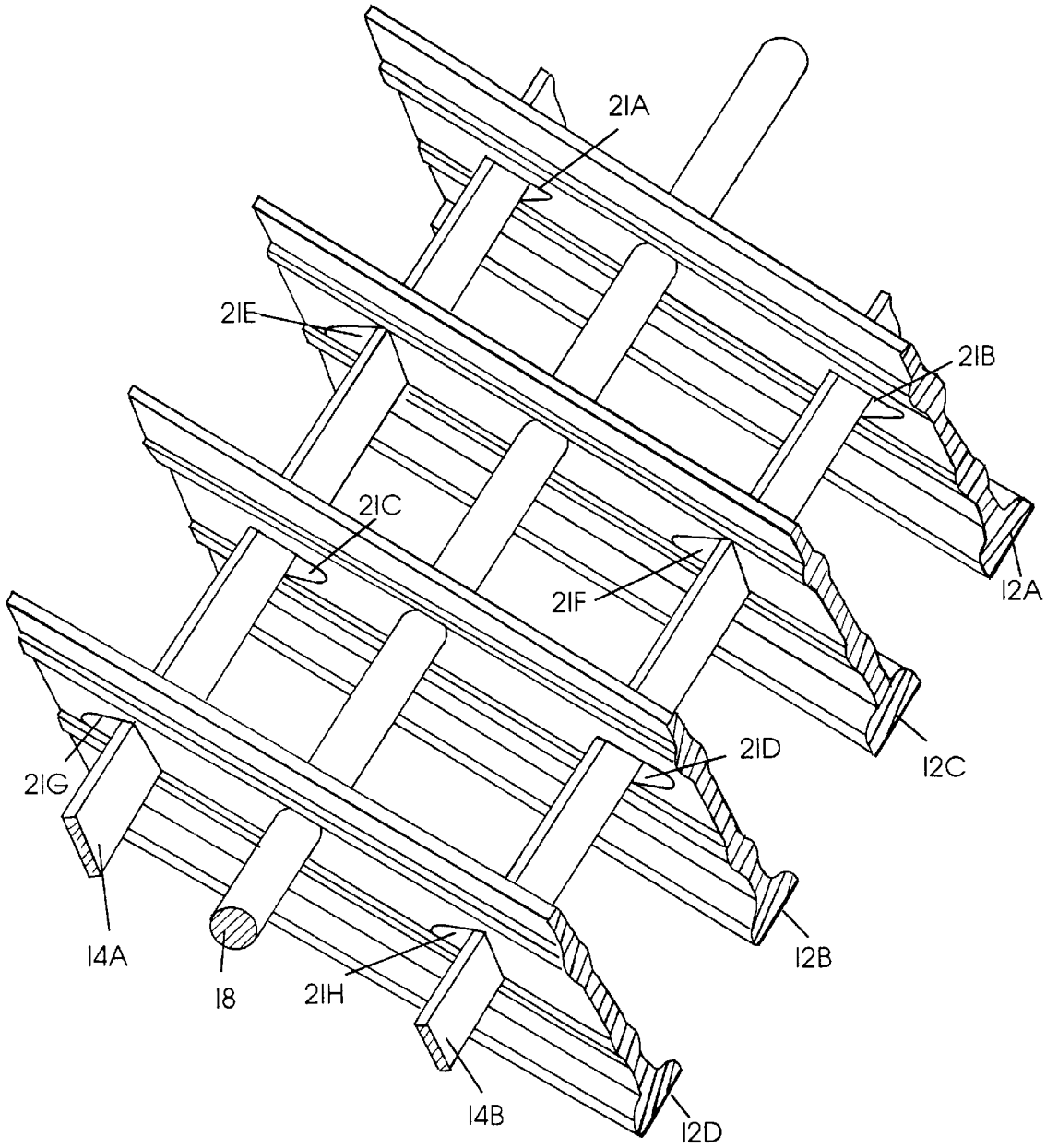
FIG. 3 is a perspective view of the subject invention showing primary load-bearing bars only after horizontal force has been applied to same for rotation of secondary load-bearing bars to a vertical position.

Referring to FIG. 1, there is shown a grating 10 in accordance with the present invention. It is noted that grating 10 may also be referred to as a grid. Grating 10 is comprised of a plurality of primary load-bearing bars as is shown with primary load-bearing bar 12A and primary load-bearing bar 12B, a plurality of transverse secondary load-bearing bars as is shown with secondary load-bearing bar 14A and secondary load-bearing bar 14B and a plurality of trimorphic load-bearing bars as is shown with trimorphic load-bearing bar 16A. Trimorphic load-bearing bar 16A provides support and eliminates weight from grating 10 and as is shown runs substantially parallel to primary load-bearing bar 12A and primary load-bearing bar 12B. Furthermore, rod 18 is shown laced through primary load-bearing bar 12A, trimorphic load-bearing bar 16A and primary load-bearing bar 12B. Rod 18 is slidably inserted through circular opening 28A, circular opening 28B and circular opening 28C. Alternatively, as shown in FIG. 2, trimorphic load-bearing bar 16A, trimorphic load-bearing bar 16B, trimorphic load-bearing bar 16C, and trimorphic load-bearing bar 16D may be utilized to construct grating 10 in coordination with secondary load-bearing bar 14A and secondary load-bearing bar 14B in further relationship with rod 18. Trimorphic load-bearing bars 16A, 16B, 16C and 16D are shown respectively with openings 20A, 20B, 20C, 20D, 20E, 20F, 20G and 20H which are cut in triangular form to receive secondary load-bearing bars 14A and 14B. Openings 20A, 20B, 20C, 20D, 20E, 20F, 20G and 20H may be constructed in a variety of different configurations other than as shown. In FIG. 3, there is illustrated a further combination whereby primary load-bearing bars 12A, 12B, 12C and 12D are arranged parallel to each other in cooperation with secondary load-bearing bars 14A and 14B and rod 18.

Figure 4:
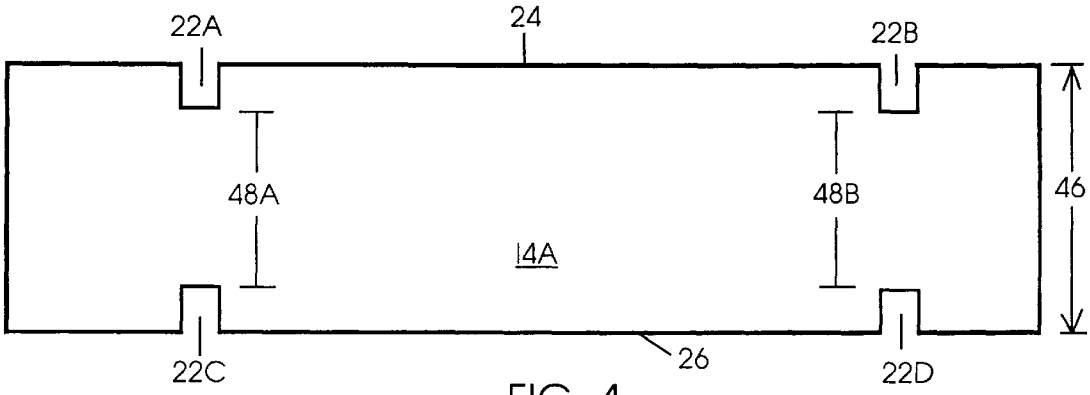
FIG. 4 is a side view of a secondary load-bearing bar being notched at a top and lower edge.

Secondary load-bearing bars 14A and 14B are shown with generally a rectangular cross-sectional configuration for cooperation with openings 20A, 20B, 20C, 20D, 20E, 20F, 20G and 20H. However, it is noted that other cross-sectional forms and shapes may be utilized. Secondary load-bearing bar 14A is shown in further detail in FIG. 4 as a preferred embodiment having notch 22A and notch 22B at an upper edge 24 and opposing notch 22C and notch 22D at a lower edge 26. Specifically, notch 22A and notch 22C are positioned opposite each other as are notch 22B and notch 22D in order to effectively engage primary load-bearing bar 12A, and likewise, load-bearing bars 12B, 12C and 12D or primary load-bearing bar 12A, primary load-bearing bar 12B and trimorphic load-bearing bar 16A as shown in FIG. 1 or any combination thereof. When secondary load-bearing bars 14A and 14B are rotated from a side wise position to a vertical position, notch 22A, 22B, 22C and 22D function as designed to provide a snug fit as notch 22A, notch 22B, notch 22C and notch 22D as shown in FIG. 4, are engaged and locked into web 30A of primary load-bearing bar 12A and web 30B of primary load-bearing bar 12B, as well as web 31A of trimorphic load-bearing bar 16A as shown in FIG. 1.

Primary load-bearing bar 12A is typical of all primary load-bearing bars and is generally constructed with a rectangular cross section, and may optionally have ribs 32A and 32B as shown in FIG. 1 and/or a flange 34A which project from either or both sides of web 30A. Openings 21A, 21B, 21C and 21D, 21E, 21F, 21G and 21H are exemplary of all openings in primary load-bearing bar 12A, 12B, 12C and 12D and are cut in triangular form to receive secondary load-bearing bars 14A and 14B. Openings 21A, 21B, 21C, 21D, 21E, 21F, 21G and 21H may be constructed in a variety of different configurations other than as shown.

Figure 5:
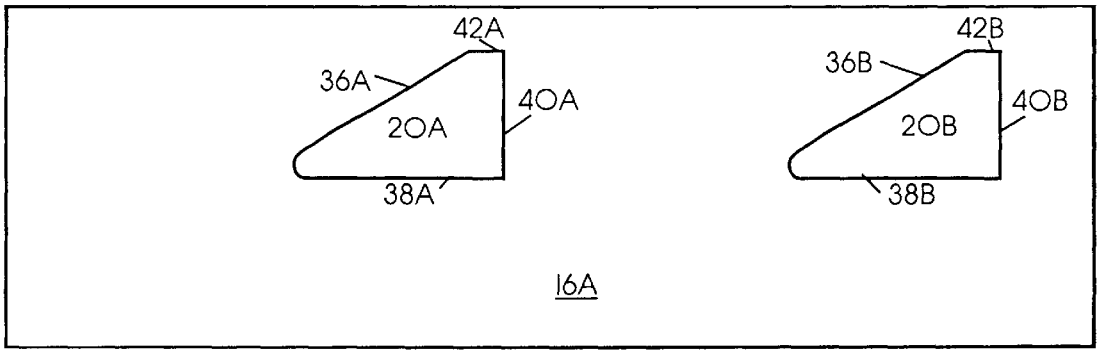
FIG. 5 is a side view of a trimorphic load-bearing bar having triangular shaped apertures.
Figure 6:
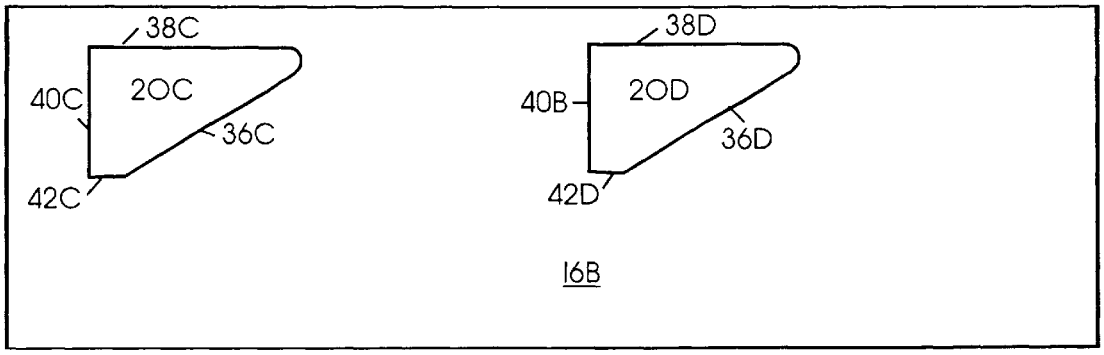
FIG. 6 is a side view of a second trimorphic load-bearing bar showing opposing and reversed apertures from those shown in FIG. 5.

Thus, as is viewed in FIGS. 5 and 6, opening 20A of trimorphic load-bearing bar 16A is comprised of hypotenuse 36A, horizontal leg 38A, vertical leg 40A and shortened extent 42A. Likewise, opening 20B of trimorphic load-bearing bar 16A is comprised of hypotenuse 36B, horizontal leg 38B, vertical leg 40B and shortened extent 42B. Opening 20A and 20C oppose each other in a cooperative fashion. Opening 20C of trimorphic load-bearing bar 16B is comprised of hypotenuse 36C, horizontal leg 38C, vertical leg 40C and shortened extent 42C. Likewise, opening 20B and 20D oppose each other in cooperative fashion. Opening 20D of trimorphic load-bearing bar 16B is comprised of hypotenuse 36D, horizontal leg 38D, vertical leg 40B and shortened extent 42D.

It is illustrated in FIG. 1 that for purposes of locking, secondary load-bearing bars 14A and 14B are inserted sidewise respectively into either primary load-bearing bar 12A, 12B and/or trimorphic load-bearing bar 16A through openings 21A and 20A and 21C and openings 21B, 20B and 21D. Viewing FIGS. 5 and 6, extents 42A and 42B are cut to cooperate with secondary load-bearing bars 14A and 14B which are inserted side wise, respectively as stated, until alignment of secondary load-bearing bar 14A is reached by notches 22A, 22B, 22C and 22D within openings 21A, 20A, 21C, and likewise, secondary load-bearing bar 14B by similar but unnumbered notches within openings 21B, 20B and 21D as shown in FIG. 1.

Opening 20A is generally constructed to be in the form of a right scalene triangle although it may be constructed in a variety of shapes. Viewing opening 20A, and specifically, vertical leg 40A, it is to be noted that vertical leg 40A is measured as less than the width 46 of secondary load-bearing bar 14A in order that secondary load-bearing bar 14A and likewise secondary load-bearing bar 14B will lock into either primary load-bearing bar 12A, primary load-bearing bar 12B and/or tertiary load-bearing bar 16A, being typical of any combination thereof. Furthermore, vertical leg 40A aligns with notch distance 48A whereby notch distance 48A represents the inside distance between notch 22A and notch 22C. Notch distance 48A is slightly less than the measurable distance of vertical leg 40A allowing a tolerance within opening 20A at vertical leg 40A for rotation of secondary load-bearing bar 14A. Likewise, vertical leg 40B aligns with notch distance 48B. Nonetheless, it is to be noted that the closer the tolerance between notch distance 48A and vertical leg 40A the greater rigidity is achieved or accomplished within grating 10 and likewise for notch distance 48B and vertical leg 40B. It is further appreciated that there is a balance of tolerances with respect to notch 22A, notch 22B, notch 22C and notch 22D and a thickness 70A and 70B of primary load-bearing bar 12A and 12B, as shown in FIG. 1, respectively, or likewise, thickness 71A of trimorphic load-bearing 16A or any combination thereof, all which enables an easy assembly and superior strength of grating 10.

Figure 7:
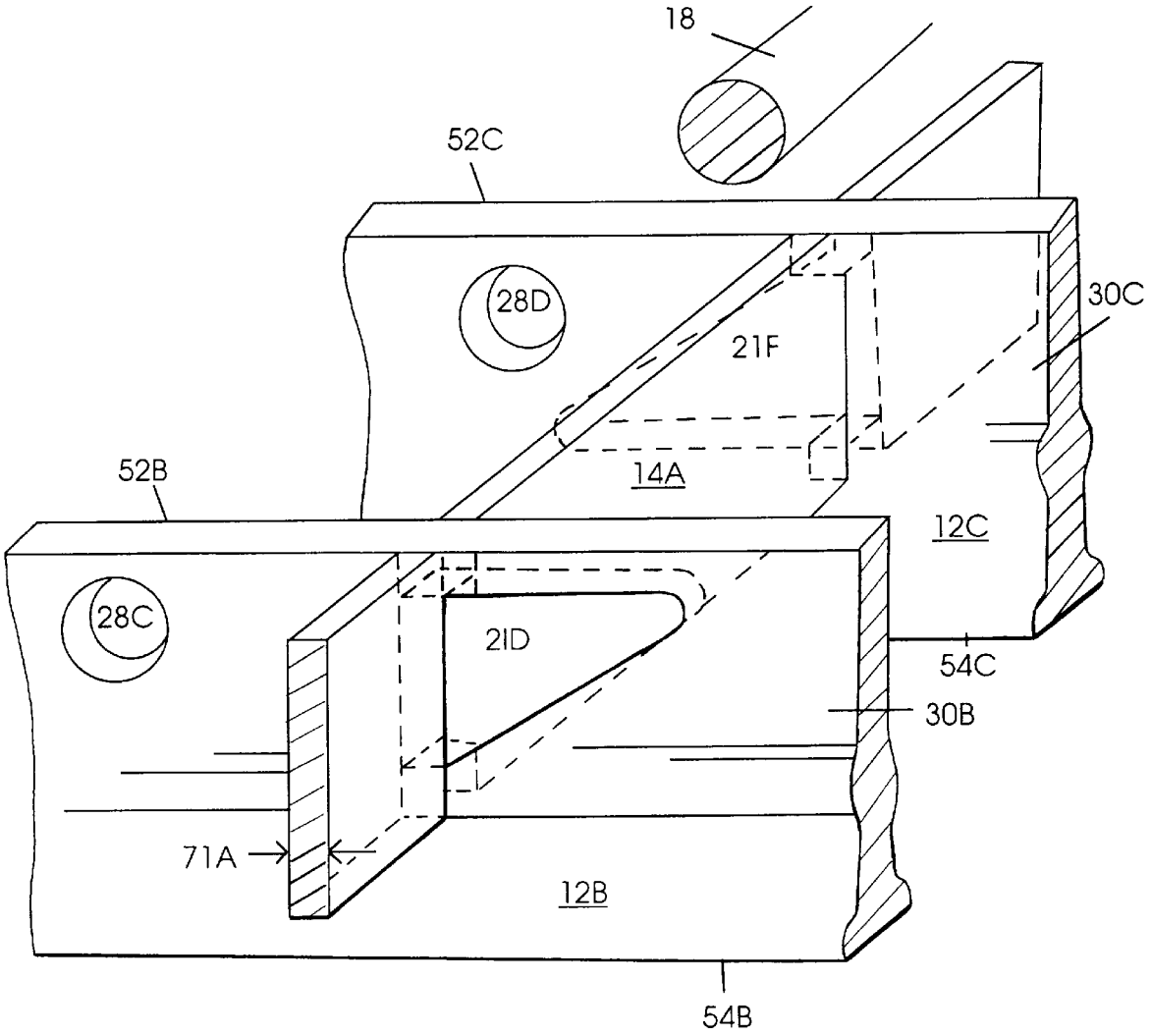
FIG. 7 is a perspective view showing primary load-bearing bars with reversed opposing apertures and a secondary load-bearing bar in vertical position through said apertures ready for insertion of rod 18.
Figure 8:
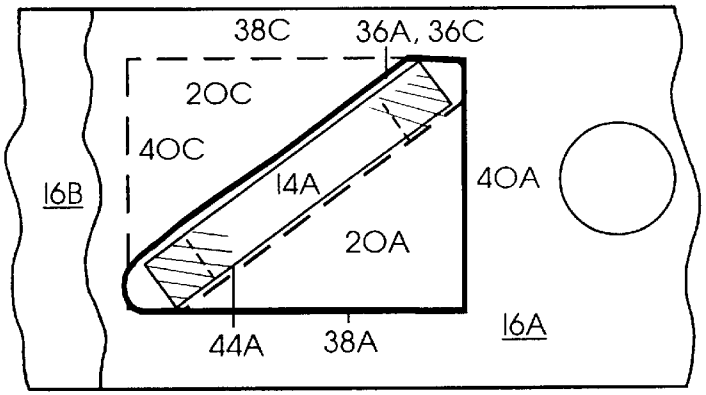
FIG. 8 is a side view of a primary load-bearing bar showing secondary load-bearing bar inserted sideways.
Figure 10:
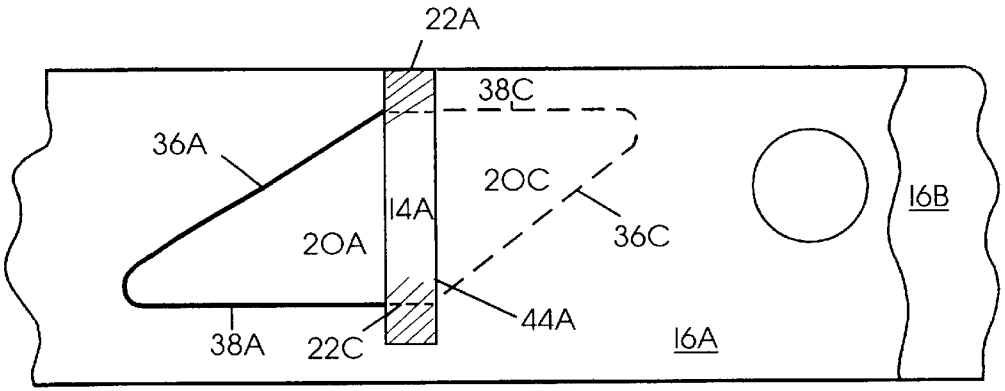
FIG. 10 is a side view for a primary load-bearing bar and another primary load-bearing bar after secondary load-bearing bar has been locked into its vertical position.
Figure 11:
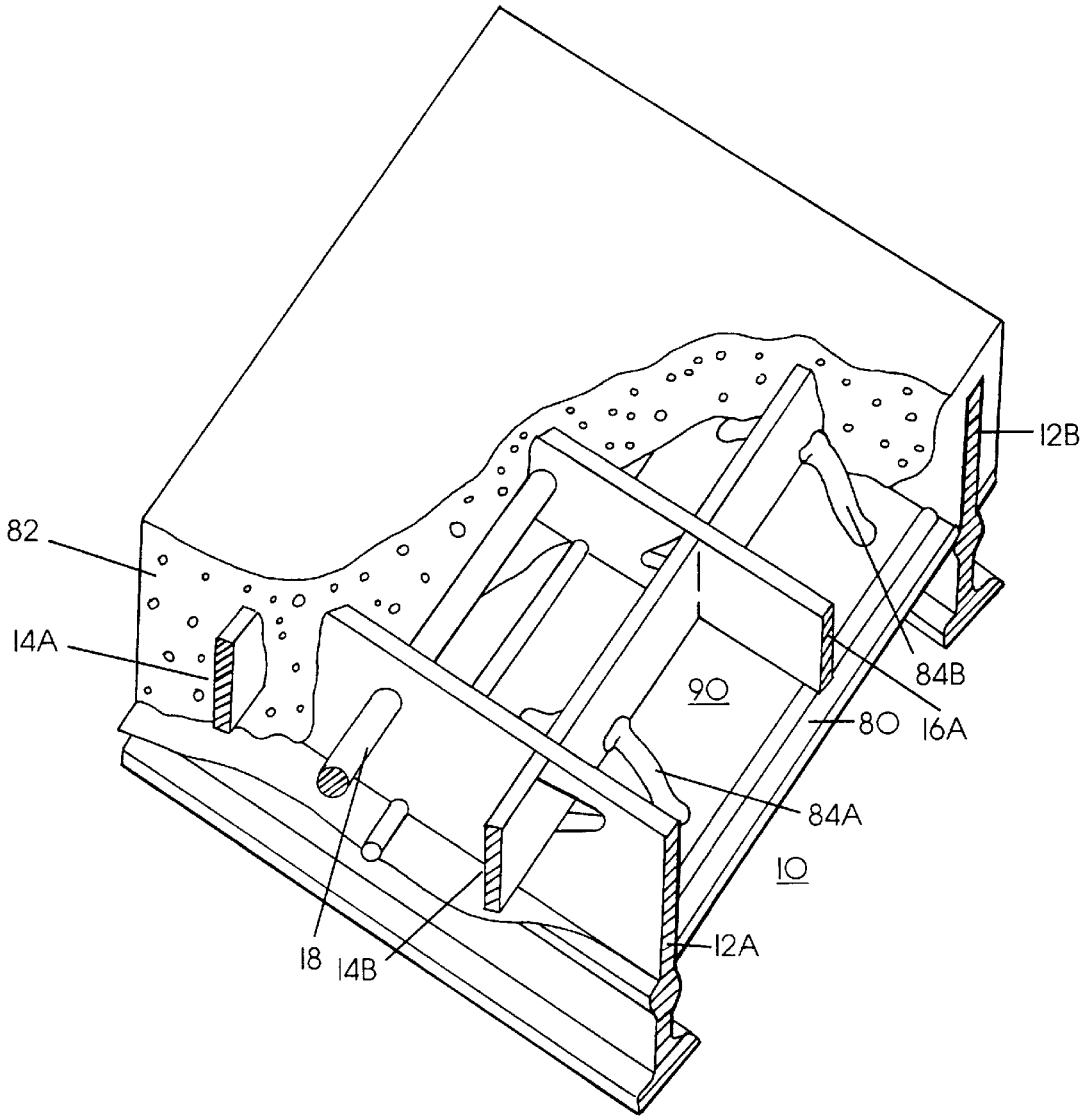
FIG. 11 is a perspective cutaway view of a weldless inter-locking grating assembly utilizing a deep web with concrete encasing a top portion of said grating.

For purposes of illustrating the assembly of grating 10 as is shown in FIGS. 1 and 11 as a preferred embodiment, secondary load-bearing bars 14A and 14B are laced through primary load-bearing bars 12A and 12B and trimorphic load-bearing bar 16A. The method of lacing secondary load-bearing bars 14A and 14B through primary load-bearing bars 12A and 12B and trimorphic load-bearing bar 16A requires secondary load-bearing bar 14A and 14B to be turned sidewise as previously stated. This is further illustrated in FIGS. 2 and 8 where secondary load-bearing bars 14A and 14B are actually shown side wise with thickness 44A of secondary load-bearing bar 14A and thickness 44B of secondary load-bearing bar 14B wherein secondary load-bearing bar 14A is inserted through openings 20A, 20C, 20E and 20G and secondary load-bearing bar 14B is inserted through openings 20B, 20D, 20F and 20H. Notches 22A, 22B, 22C and 22D, being typical, coincide or align with web 31A, of trimorphic load-bearing bar 16A and web 31B of trimorphic load-bearing bar 16B when rotated counterclockwise by sliding trimorphic load-bearing bars 16A and 16C in opposite direction to trimorphic load-bearing bars 16B and 16D. Secondary load-bearing bars 14A and 14B automatically come into alignment in accordance with FIGS. 1, 2, 3, 10 and 11. As shown in FIG. 1, slidable movement of trimorphic load-bearing bar 16A in the opposite direction to primary load-bearing bar 12A and primary load-bearing bar 12B causes secondary load-bearing bars 14A and 14B to be positioned vertically. When secondary load-bearing bars 14A and 14B are in this vertical position, web 30A and web 30B are engaged by or inserted into notches 22A, 22B, 22C and 22D, respectively, being typical as upper edge 24 and lower edge 26 of secondary load-bearing bar 14A concurrently with web 30A, and likewise, secondary load-bearing bar 14B and concurrrently with web 30B are engaged by insertion into notches 22A, 22B, 22C and 22D. Grating 10 becomes engaged and locked into a fixed position with notches 22A and 22B at upper edge 24 of secondary load-bearing bar 14A and also is further engaged by or locked into notch 22C and notch 22D at lower edge 26 of secondary load-bearing bar 14A. Trimorphic load-bearing bar 16A functions in cooperation with the aforesaid. While secondary load-bearing bar 14A is maintained in its upright position as shown in FIG. 7, then upper edge 52B and lower edge 54B of primary load-bearing bar 12B and upper edge 52C and lower edge 54C of primary load-bearing bar 12C are prevented from moving in the direction of each other as shown and secondary load-bearing bars 14A and 14B are maintained in a substantially vertical position and by lacing rod 18 through circular opening 28C of web 30B and circular opening 28D of web 30C of primary load-bearing bar 12B and primary load-bearing bar 12C, respectively, trimorphic load-bearing bar 16A as shown in FIG. 1 or typically in any other combination as shown in FIGS. 2 and 3. Grating 10 is effectively tied together subsequent to the within-described mechanical action.

Figure 9:
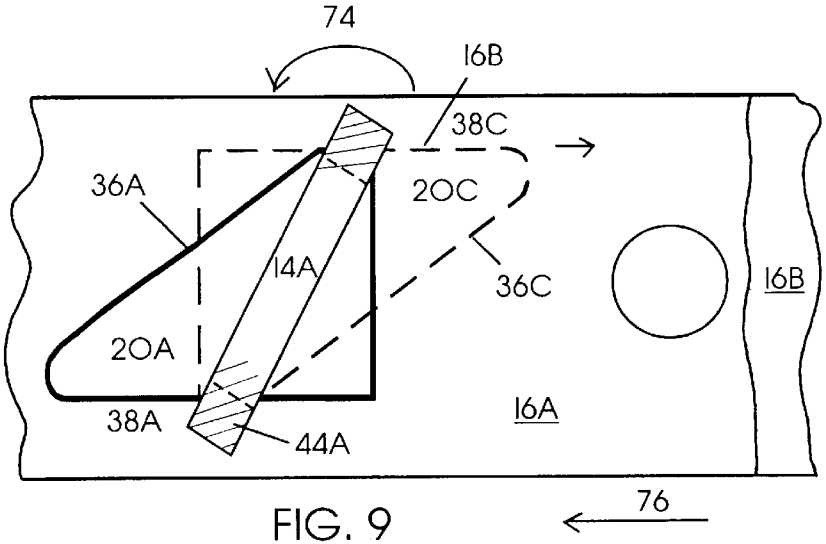
FIG. 9 is a side view of a primary load-bearing bar showing a secondary load-bearing bar being rotated counterclockwise as a primary load-bearing bar moves in a rightward direction.

A closer examination of openings 20A, 20B, 20C and 20D is seen in FIGS. 5 and 6. As is shown in FIG. 9, secondary load-bearing bar 14A is seen as rotating from a side wise position as seen in openings 20A and 20C. Trimorphic load-bearing bar 16A is moved by horizontal motion 76 opposite to trimorphic load-bearing bar 16B, secondary load-bearing bar 14A begins to cause counterclockwise rotation 74 as is shown in FIG. 9. When secondary load-bearing bar 14A is finally in the vertical position as shown in FIG. 10, grating 10 is completely locked to achieve superior rigidity. Thus, any further lateral movement is prevented. Although not shown, it is noted that rod 18 may be bent, fitted with a pin or even threaded to secure a nut all of which acts to further secure grating 10. It is further noted that through the described process, grating 10 has been secured without attendant problems associated and inherent with welding, riveting or otherwise. Furthermore, by use of rod 18, grating 10 accomplishes superior strength and prevents lateral movement. Further with respect to rod 18, it has been shown as a round bar, but may be of any cross-sectional configuration.

In addition, because grating 10 does not require welds and may be assembled on site, and in particular, bridge sites to minimize shipping costs, it is important that grating 10 be capable of assembling of a jig as is normally required for welded decks or structures such as grating 10. Thus, it is important that all components of grating 10 remain in place until locking as aforesaid is accomplished.

Viewing FIG. 7, and in particular, load-bearing bar 14A as shown in a vertical position locked with web 30A and web 30B, respectively, of primary load-bearing bar 12A and primary load-bearing bar 12B at notches 22A, 22B, 22C and 22D as seen in FIG. 4. Notches 22A, 22B, 22C and 22D are cut in appropriate form to provide a very snug fit over web 30A and web 30B as shown in FIG. 1 causing primary load-bearing bar 12A and primary load-bearing bar 12B to remain static in a fixed position as shown in the various illustrations being substantially parallel to all other primary load-bearing bars, including but not limited to primary load-bearing bar 12A and 12B or any combination of primary load-bearing bars, secondary load-bearing bars and trimorphic load-bearing bars as shown in all drawings appended hereto.

FIG. 11, perspectively and schematically, illustrates concrete 82 in an upper area of grating 10 above pan surface 90 of pan 80. It should be understood that while grating 10 is shown encasing a top volumetric area of grating 10 as shown in FIG. 11, that concrete 82 may extend above and/or below grating 10 depending on construction and engineering considerations. Thus, grating 10 may be three-dimensionally and substantially encapsulated with concrete 82.

Figure 12:
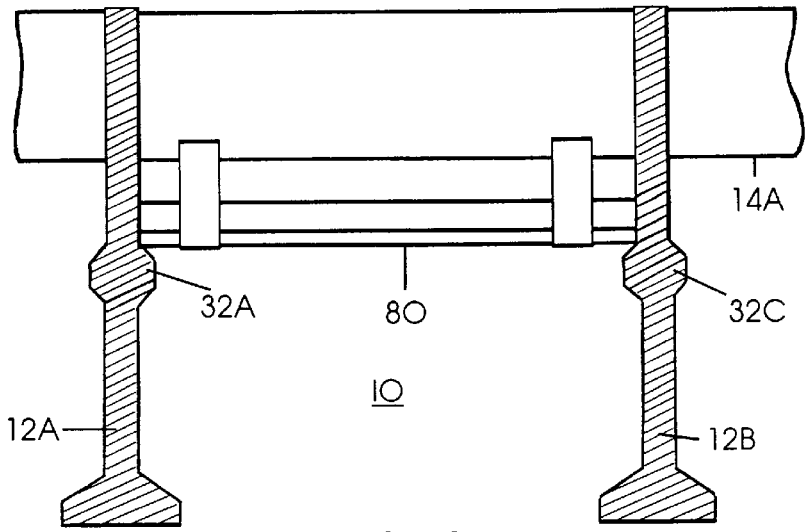
FIG. 12 is an end view along a primary load-bearing bar showing a pan mounted on ribs of primary load-bearing bars in order to contain wet concrete or a like substance.
Figure 13:
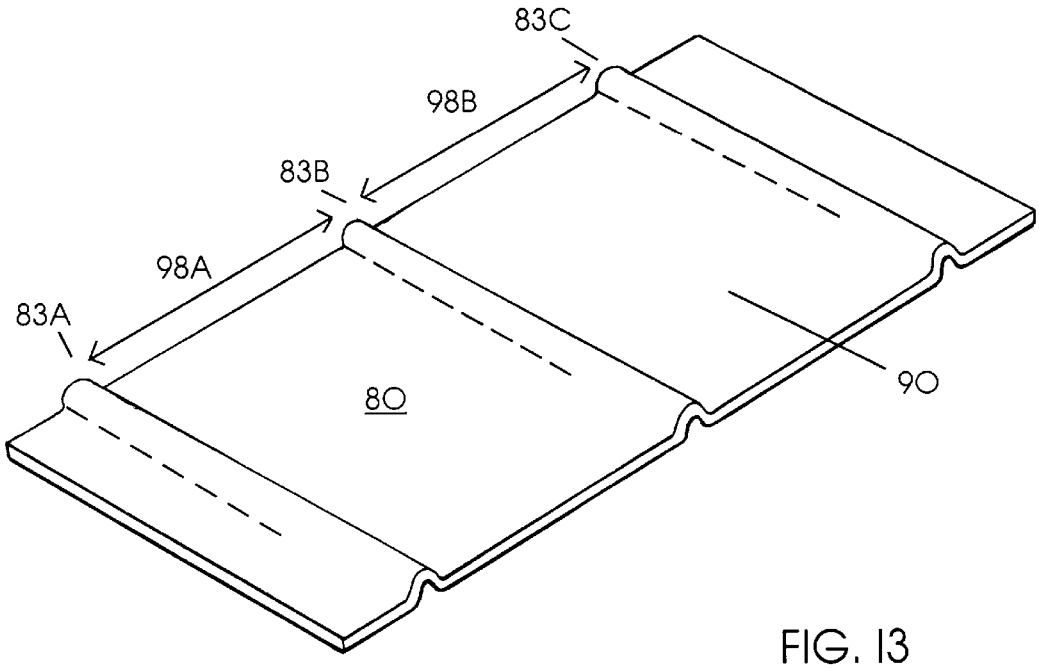
FIG. 13 is a perspective view of a pan.
Figure 14:
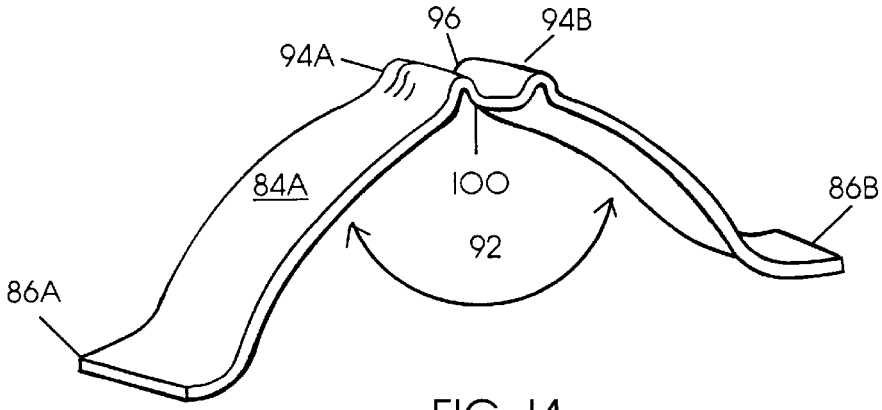
FIG. 14 is a perspective view of a spring clip.

In the event it is desired that for engineering and other construction reasons, a portion of grating 10 be encased in concrete 82, pan 80 being of sheet-like material, is positioned between primary load-bearing bar 12A and primary load-bearing 12B as shown in FIG. 12. Pan 80 is constructed to extend the length of primary load-bearing bar 12A and primary load-bearing bar 12B and to rest at its edges on rib 32A and rib 32C. Thus, pan 80 is preferably shaped substantially as shown in FIG. 13 consisting of rib 82A, rib 82B, and rib 82C which extend a width of pan 80 generally in a parallel direction to secondary load-bearing bar 14A and secondary load-bearing bar 14B. Rib 83A, rib 83B and rib 83C are constructed to make pan 80 an unyielding member. When concrete 82 as shown in FIG. 11 is selected as a wear surface or to partially encapsulate grating 10, pan 80 is positioned between primary load-bearing bar 12A and primary load-bearing bar 12B. Enhancing this construction are spring clip 84A and spring clip 84B which act cooperatively to firmly secure pan 80. While spring clip 84A and spring clip 84B may be constructed from a variety of materials, they are generally constructed from a thin, flat metallic material which when arched allows for a leaf-spring effect between end 86A and end 86B as shown, a particular example of spring clip 84A in FIG. 14. End 86A and end 86B are detailed and designed to securely be placed and rest upon surface 90 being a flat surface of pan 80. Arch 92 is indicated at the center of spring clip 84A consisting of rise 94A and rise 94B vertically impressed in the construction of spring clip 84A at apex 100 of arch 92. A distance 96 separates rise 94A from rise 94B, this distance being measured to be minimally greater than thickness 71A of secondary load-bearing bar 14A. While securing pan 80 into a firm position, it is noted that pan 80 may be readily removed if adjustment is determined to be reasonable and necessary. Thus, grating 10 may be shipped to any jobsite without pan 80 being removed or otherwise dropped from grating 10. It may be noted that in the absence of the present invention, pan 80, when secured in position, may result in warpage thereto. The subject warpage does result in uneven thickness of concrete 82 and also between space 98A and space 98B located between rib 83A, rib 83B, and rib 83C, respectively, of pan 80 which further complicates construction matters creating undesired wetness in concrete 82, as well as seepage and/or dripping onto any lower surface below grating 10. Assembled grating 10, in accordance with the present invention as specifically shown in FIG. 1, has a rigid configuration resultant in reduction of any substantial movement to the entire structure of grating 10. Thus, primary load-bearing bar 12A and primary load-bearing bar 12B will not move or wobble, and pan 80 may be placed on or inserted between primary load-bearing bar 12A and primary load-bearing bar 12B prior to shipment of grating 10.

It may be seen that grating 10 as constructed in accordance with the present invention, does overcome disadvantages of welded gratings referred to earlier and in common usage. However, even though welds may be applied to grating 10 of the present invention, welding is known and believed to be more detrimental than advantageous, because welding studies indicate embrittlement, and therefore, allows for occurrence of a frequent site failure, and in particular, what is technically known as a fatigued failure of the major structure to which the present invention grating 10 is essential. It is to be noted that the term "weldless" as used herein takes into account and includes minor welding which is often used or may be used to secure rod 18 in its appropriate place. In the event this is the case, it is contemplated within the purview of the present invention grating 10.

Grating 10 may be fabricated from a variety of metals, including steel, ferrous and non-ferrous metals, titanium, carbon fiber composites, carbon steel, stainless steel, aluminum alloys, like materials, including but not limited to, plastics, and in particular, fiberglass-reinforced plastics.

In the present invention, galvanizing of structural bars, either prior to or after assembly, will enhance the lifespan of grating 10 and all its described components. However, if grating 10 is galvanized prior to assembly, touch up is often necessary to cure scratches and like damage resulting from assembly. Furthermore, the present invention, and in particular, notch 22A, notch 22B, notch 22C and notch 22D are precisely dimensioned to provide minimum tolerance and a highly snug fit lessening any chance that debris will collect when grating 10 is open to environmental elements causing corrosion, such as salt and other harsh chemicals often used on highways and bridges.

In accordance with the provisions of the patent statutes, I have explained the principle and operation of my invention and have illustrated and described what I consider to represent the best embodiment thereof.

I claim:

1. An automated weldless, inter-locking grating assembly for bridge decks, comprising:

a multiplicity of laterally extending primary load-bearing structural components, said primary load-bearing structural components having a web section extending vertically and located within said web section spaced triangular apertures, above said spaced triangular apertures an upper section of primary load-bearing structural components, said spaced triangular apertures function in cooperation with directly opposing spaced triangular apertures located within adjacent primary load-bearing structural components;

a multiplicity of secondary load-bearing structural components transversely located in relation to said primary load-bearing structural components, having a notched upper edge and a notched lower edge whereby said secondary load-bearing structural components may be positioned through said spaced triangular apertures of said web section by sliding said secondary load-bearing structural components side wise through said spaced triangular apertures enabling engagement of said secondary load-bearing structural components into said primary load-bearing structural components to create an interlocked static position of said grating assembly;

wherein said notches are spaced to engage said web section when said secondary load-bearing structural components are rotated from said side wise position to a vertical position by horizontal motion of said primary load-bearing structural components, locking said primary load-bearing structural components into said secondary load-bearing structural components into an inter-locked static position, wherein said notches intersect with said web section of said primary load-bearing structural components;

a multiplicity of trimorphic load-bearing structural components alternately positioned between said primary load-bearing structural components for said locking into said secondary load-bearing structural components when said secondary load-bearing structural components are rotated from said side wise position to said vertical position;

a rod slidably inserted through rod openings of said web of said primary load-bearing structural components and said trimorphic load-bearing structural components causing said grating assembly to achieve maximum rigidity and preventing lateral movement of said multiplicity of primary load-bearing structural components and said trimorphic load-bearing structural components of said grating assembly.

2. An automated weldless inter-locking grating assembly according to claim 1, wherein said multiplicity of primary load-bearing structural components further have a flanged bottom section extending along a lower edge of said primary load-bearing structural components.

3. An automated weldless inter-locking grating assembly according to claim 1, wherein said trimorphic load-bearing structural components are generally constructed to be of rectangular cross-section for purposes of providing additional support and simultaneously eliminating weight which is inherent in said primary load-bearing structural components which are generally constructed with a flanged bottom section and a rib located above said flanged bottom section, said rib parallel to said flanged bottom section and said rib extending laterally along said web.

4. An automated weldless inter-locking grating assembly according to claim 1, wherein said spaced triangular apertures are constructed to be of triangular form for reception of said secondary load-bearing structural components.

5. An automated weldless inter-locking grating assembly according to claim 1, wherein said spaced triangular apertures are constructed to form a right scalene triangle having a horizontal leg, a vertical leg 90 degrees to said horizontal leg, a hypotenuse connecting said horizontal leg to said vertical leg and a shortened extent parallel to and opposing said horizontal leg, such that said spaced triangular apertures of said adjacent primary load-bearing structural components and said adjacent trimorphic load-bearing structural components oppose each other in incongruent but cooperative fashion enabling said secondary load-bearing structural components in said locked vertical position at said shortened extents whereby said shortened extents of said adjacent primary load-bearing structural components and said adjacent trimorphic load-bearing structural components to be in spaced apart aligned opposing relationship.

6. An automated weldless inter-locking grating assembly according to claim 1, wherein said primary load-bearing structural components are substantially of rectangular cross section.

7. An automated weldless inter-locking grating assembly according to claim 1, wherein said primary load-bearing structural components are constructed with said rib parallel to said flanged bottom section and said rib being located below said spaced triangular apertures and below said secondary load-bearing structural components, said rib for providing support to a pan, said pan to rest on said rib at an edge of said pan, said pan to rest between adjacent primary load-bearing structural components, said pan extends along said rib and parallel to said bottom edge of said secondary load-bearing structural components, said pan for holding concrete within said grating assembly.

8. An automated weldless inter-locking grating assembly according to claim 2, wherein said trimorphic load-bearing structural components are generally constructed to be of rectangular cross-section for purposes of providing additional support and simultaneously eliminating weight which is inherent to said primary load-bearing structural components which are generally constructed of said flanged bottom section and a rib located above said flanged bottom section, said rib parallel to said flanged bottom section and said rib extending laterally along said web.

9. An automated weldless inter-locking grating assembly according to claim 8, wherein said spaced triangular apertures are constructed to be of triangular form for reception of said secondary load-bearing structural components.

10. An automated weldless inter-locking grating assembly according to claim 9, wherein said inter-locked static position is achieved by said horizontal motion of said primary load-bearing structural components in opposite direction to horizontal motion of said trimorphic load-bearing structural components causing rotation of said secondary load-bearing structural components into said vertical position.

11. An automated weldless inter-locking grating assembly according to claim 10, wherein said spaced triangular apertures are constructed to form a right scalene triangle having a horizontal leg, a vertical leg 90 degrees to said horizontal leg, a hypotenuse connecting said horizontal leg to said vertical leg and a shortened extent parallel and opposing said horizontal leg, such that said spaced triangular apertures of said adjacent primary load-bearing structural components and said adjacent trimorphic load-bearing structural components oppose each other in cooperative fashion enabling said secondary load-bearing structural components to achieve said locked vertical position at said shortened extents whereby said shortened extents of said adjacent primary load-bearing structural components and said adjacent trimorphic load-bearing structural components to be in spaced apart aligned opposing relationship.

12. An automated weldless inter-locking grating assembly according to claim 11, wherein said primary load-bearing structural components are substantially of rectangular cross-section.

13. An automated weldless inter-locking grating assembly according to claim 12, wherein said primary load-bearing structural components are constructed with said rib parallel to said flanged bottom section and said rib being located below said spaced apertures and below said secondary load-bearing structural components, said rib for providing support to a pan, said pan to rest on said rib at an edge of said pan, said pan to rest between adjacent primary load-bearing structural components, said pan extends along said rib parallel to said bottom edge of said secondary load-bearing structural components, said pan for holding concrete within said grating assembly.

14. An automated weldless inter-locking grating assembly according to claim 13, further comprising a spring means which functions cooperatively at a lower edge of secondary load-bearing structural components to exert a vertical force at said lower edge of secondary load-bearing structural components and securing said pan in a firm position allowing said grating to be shipped to any jobsite without removal of said pan and preventing any warpage to said pan.

15. An automated weldless, inter-locking grating assembly for bridge decks comprising:

a multiplicity of laterally extending primary load-bearing structural components, said primary load-bearing structural components having a web section extending vertically and located within said web section spaced triangular apertures, above said spaced triangular apertures an upper section of primary load-bearing structural components, said spaced triangular apertures function in cooperation with directly opposing spaced triangular apertures located within adjacent primary load-bearing structural components;

a multiplicity of secondary load-bearing structural components transversely located in relation to said primary load-bearing structural components, having a notched upper edge and a notched lower edge whereby said secondary load-bearing structural components may be positioned through said spaced triangular apertures of said web section by sliding said secondary load-bearing structural components side wise through said spaced triangular apertures enabling engagement of said secondary load-bearing structural components into said primary load-bearing structural components to create an interlocked static position of said grating assembly;

wherein said notches are spaced to engage said web section when said secondary load-bearing structural components are rotated from said side wise position to a vertical position by horizontal motion applied alternately to said primary load-bearing structural components, locking said primary load-bearing structural components into said secondary load-bearing structural components into an inter-locked static position, wherein said notches intersect with said web section of said primary load-bearing structural components;

a rod slidably inserted through rod openings of said web of said primary load-bearing structural components causing said grating assembly to achieve maximum rigidity and preventing lateral movement of said multiplicity of primary load-bearing structural components of said grating assembly.

16. An automated weldless inter-locking grating assembly according to claim 15, wherein said multiplicity of primary load-bearing structural components further have a flanged bottom section extending along a lower edge of said primary load-bearing structural components.

17. An automated weldless inter-locking grating assembly according to claim 16, wherein said spaced triangular apertures are constructed to be of triangular form for reception of said secondary load-bearing structural components.

18. An automated weldless inter-locking grating assembly according to claim 17, wherein said primary load-bearing structural components are substantially of rectangular cross section.

19. An automated weldless inter-locking grating assembly according to claim 18, wherein said primary load-bearing structural components are constructed with a rib parallel to a flanged bottom section and said rib being located below said spaced triangular apertures and below said secondary load-bearing structural components, said rib for providing support to a pan, said pan to rest on said rib at an edge of said pan, said pan to rest between adjacent primary load-bearing structural components, said pan extends along said rib and parallel to said bottom edge of said secondary load-bearing structural components, said pan for holding concrete within said grating assembly.

20. An automated weldless, inter-locking grating assembly according to claim 19, wherein said pan is corrugated having a plurality of ribs.

21. An automated weldless, inter-locking grating assembly according to claim 19, wherein said pan is secured between two of said primary load-bearing structural components by use of a plurality of spring clips.

22. An automated weldless, inter-locking grating assembly according to claim 21, wherein said spring clips are leaf springs having an arched shape consisting of two feet resting on an upper surface of said pan and at an apex of said arched shape, said spring clip through a notched section touches and secures to said secondary load-bearing structural component.

23. An automated weldless, inter-locking grating assembly for bridge decks comprising:

a multiplicity of laterally extending trimorphic load-bearing structural components, said trimorphic load-bearing structural components having a web section extending vertically and located within said web section spaced triangular apertures, above said spaced triangular apertures an upper section of trimorphic load-bearing structural components, said spaced triangular apertures function in cooperation with directly opposing spaced triangular apertures located within adjacent trimorphic load-bearing structural components;

a multiplicity of secondary load-bearing structural components transversely located in relation to said trimorphic load-bearing structural components, having a notched upper edge and a notched lower edge whereby said secondary load-bearing structural components may be positioned through said spaced triangular apertures of said web section by sliding said secondary load-bearing structural components side wise through said spaced triangular apertures enabling engagement of said secondary load-bearing structural components into said trimorphic load-bearing structural components to create an interlocked static position of said grating assembly;

wherein said notches are spaced to engage said web section when said secondary load-bearing structural components are rotated from said sidewise position to a vertical position by horizontal motion applied alternately to said trimorphic load-bearing structural components, locking said trimorphic load-bearing structural components into said secondary load-bearing structural components into an inter-locked static position, wherein said notches intersect with said web section of said trimorphic load-bearing structural components;

a rod slidably inserted through rod openings of said web of said trimorphic load-bearing structural components causing said grating assembly to achieve maximum rigidity and preventing lateral movement of said multiplicity of trimorphic load-bearing structural components of said grating assembly.

24. An automated weldless inter-locking grating assembly according to claim 23, wherein said multiplicity of trimorphic load-bearing structural components further have a flanged bottom section extending along a lower edge of said trimorphic load-bearing structural components.

25. An automated weldless inter-locking grating assembly according to claim 24, wherein said trimorphic load-bearing structural components are generally constructed to be of rectangular cross-section for purposes of providing additional support and simultaneously eliminating weight which is inherent in primary load-bearing structural components which are generally constructed with a flanged bottom section and a rib located above said flanged bottom section, said rib parallel to said flanged bottom section and said rib extending laterally along said web.

26. An automated weldless inter-locking grating assembly according to claim 25, wherein said spaced triangular apertures are constructed to be of triangular form for reception of said secondary load-bearing structural components.

27. An automated weldless, inter-locking grating assembly for bridge decks comprising:

a multiplicity of laterally extending primary load-bearing structural components, said primary load-bearing structural components having a web section extending vertically and located within said web section spaced triangular apertures, above said spaced triangular apertures an upper section of primary load-bearing structural components, said spaced triangular apertures function in cooperation with opposing spaced triangular apertures located within adjacent primary load-bearing structural components;

a multiplicity of secondary load-bearing structural components transversely located in relation to said primary load-bearing structural components, having a notched upper edge and a notched lower edge whereby said secondary load-bearing structural components may be positioned through said spaced triangular apertures of said web section by sliding said secondary load-bearing structural components side wise through said spaced triangular apertures enabling engagement of said secondary load-bearing structural components into said primary load-bearing structural components to create an interlocked static position of said grating assembly;

wherein said notches are spaced to engage said web section when said secondary load-bearing structural components are rotated from said side wise position to a vertical position by horizontal motion of said primary load-bearing structural components, locking said primary load-bearing structural components into said secondary load-bearing structural components into an inter-locked static position, wherein said notches intersect with said web section of said primary load-bearing structural components, wherein said interlocked static position is achieved by said horizontal motion of said primary load-bearing structural components in opposite direction to horizontal motion of said trimorphic load-bearing structural components causing rotation of said secondary load-bearing structural components into said vertical position.

* * * * *